US006300822B1

(12) United States Patent
Cardanha et al.

(10) Patent No.: US 6,300,822 B1
(45) **Date of Patent: *Oct. 9, 2001**

(54) ON CHIP CMOS VLSI REFERENCE VOLTAGE WITH FEEDBACK FOR HYSTERESIS NOISE MARGIN

(75) Inventors: Brian Cardanha, Sunnyvale, CA (US); Dan Stotz, Fort Collins, CO (US); Kent R. Townley, Richardson, TX (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/104,921

(22) Filed: Jun. 25, 1998

(51) Int. Cl.[7] ..... G05F 1/10
(52) U.S. Cl. ..... 327/540
(58) Field of Search ..... 327/74, 76, 87, 327/78, 205, 206, 199, 540

(56) References Cited

U.S. PATENT DOCUMENTS 4,926,068 * 5/1990 Fujita ..... 327/205
5,418,409 * 5/1995 Kuhn ..... 327/205
5,565,802 * 10/1996 Kohno ..... 327/205
5,610,545 * 3/1997 Jenkins et al. ..... 327/205
5,894,234 * 4/1999 Morris ..... 327/205

* cited by examiner

*Primary Examiner*—Jung Ho Kim

(57) ABSTRACT

The inventive mechanism provides a hysteresis margin to a comparator. The inventive mechanism generates two different voltage values, one high level and one low level, which forms the noise margin. The mechanism will select the proper level based on the output of the comparator. The comparator will then use the selected reference voltage, having either a slightly higher or lower level than a nominal reference value, as the reference voltage in its operations. The difference between each level and the nominal level is the added hysteresis noise margin. The inventive mechanism uses the higher voltage level when the output of the comparator is below the nominal reference voltage, and uses the lower voltage level when the output of the comparator is above the nominal reference voltage. Thus, a noise spike in the input signal would have to be larger than the margin provided by the mechanism, before causing the comparator to react to the noise in the signal. Since the mechanism is separate from the comparator, different comparators do not have be designed and tested. The mechanism can be disabled by a shorting some of the nodes of the mechanism together during the metal layer step of the device fabrication.

31 Claims, 3 Drawing Sheets

ON CHIP CMOS VLSI REFERENCE VOLTAGE WITH FEEDBACK FOR HYSTERESIS NOISE MARGIN

TECHNICAL FIELD OF THE INVENTION

This application relates in general to a reference voltage for a CMOS chip, and in specific to a mechanism which includes a feedback arrangement with a comparator and provides a dual level reference voltage to the comparator based upon the output of the comparator.

BACKGROUND OF THE INVENTION

The prior art typically forms a fixed voltage from a voltage divider. The fixed voltage serves as an on-chip reference voltage. For example, as shown in FIG. 5, voltage divider 51 provides a reference voltage $V_{ref}$ 52 to comparator 53. When the input signal, $V_{IN}$ 54, exceeds the reference voltage $V_{ref}$ 52, the comparator 53 will trigger and change the output signal 55, typically from low to high. The voltage divider 51 forms $V_{ref}$ 52 from $V_{TT}$ 57. The arrangement 50 is typically used as single-ended receiver circuit, with $V_{DD}$ 56 being an on chip power supply voltage, while $V_{IN}$ 54 is an off chip signal. The internal arrangement of the voltage divider 51 typically comprises two nFET transistors with the source of the first one tied to the drain of the second. The drain of the first FET is tied to $V_{TT}$ 57, and the source of the second FET is tied to ground. The gates of both FETS are connected to $V_{DD}$ 56. Note that for proper operation $V_{DD}>V_{TT}$+FET threshold voltage. The FETs are sized to produce the required reference voltage, i.e. $V_{ref}$ 52. The voltage divider could also use PVT (process, voltage, temperature) compensation to attempt to minimize drift from changes in process, power supply voltage $V_{DD}$, or temperature, and thereby make the reference voltage more stable. Note that a voltage divider may also be formed from two pFETs in series or from a circuit comprising a pFET connected to $V_{TT}$ and a nFET connected to ground.

Another approach of the prior art is to produce the reference voltage off chip using two discrete resistors. The reference voltage is then brought on chip through at least one pin. However, this approach requires the signal to be routed along the PC board, which introduces noise into the reference voltage signal. If higher capacitive route is used requiring either wide traces or bypass capacitors, then the noise is reduced. However, cleaner power distribution mechanisms may reduce the area available for other mechanisms. Note that the large area forms a capacitance with the ground plane that stabilizes the signal. Using pins to bring the signal on chip also introduces noise into the reference signal. If more pins are used, then the noise is reduced. However, the more pins that are used for the reference voltage, reduces the number of pins available for other signals. Note that a high pin count stabilizes the signal by reducing loop inductance. Thus, these two trades offs make this approach undesirable.

Noise tolerance is a problem with arrangement 50. Ringing or other noise would cause the $V_{IN}$ 54 input signal to cross the reference voltage $V_{ref}$ 52. Thus, the comparator would inadvertently trip, and possibly send an incorrect signal onto other portions of the chip. Note that noise can be caused by crosstalk, such that another signal couples with the input signal line $V_{IN}$ 54. Other noise can be caused by reflections from impedance mismatch from different media connections.

FIGS. 6A–6D depict the effects of noise on the arrangement of FIG. 5. Each of the graphs of FIGS. 6A–6D depict various voltages of the arrangement of FIG. 5 at a common reference time. Note that the time line is in nanoseconds. The off chip signal 57 is the signal generated by an off chip (i.e. off of the comparator chip) device. The off chip driving signal is the signal sent by the driving circuit of the off chip device. Note the noise introduced by the transmission line effects. This signal, which is received by the receiving circuitry, $V_{IN}$ 54, is replete with noise when compared with off chip signal 57. Some of the noise spikes are above the reference voltage $V_{ref}$ 52. Spikes 61 and 62 are high enough to the comparator output signal 55 to exceed the receiver latch threshold voltage 59, as shown by 61' and 62'. Thus, the noise has caused erroneous signals to be propagated through the receiving chip.

The prior art has attempted to solve this problem by constructing the comparator with a built-in hysteresis mechanism, using feedback. The hysteresis comparator has the values of the FETs inside the comparator changed from a standard comparator. In a standard comparator, there are two branches, one connected to the positive input and one connected to the negative input. The FET sizes, connected to both the positive input and the negative input, are closely matched. If the positive and negative inputs are identical, then the currents going through are equal. When there is the slightest difference between the positive and the negative inputs, the comparator will switch to whichever branch has the higher gate voltage. If the FET sizes are changed, then the currents are thrown off balance and therefore, create an unevenness as to where the output will switch. Thus, the comparator will switch with some offset. In order for the output of the comparator to switch, a greater change in the input signal is required, e.g. if the signal is low and the threshold has been increased, then the input signal must go slightly above the original threshold voltage before the comparator will trip. This provides some measure of tolerance of noise, and prevents improper comparator tripping.

However, this solution has several disadvantages. First, the design of the hysteresis comparator is not portable. Each comparator would have be constructed with different elements, reflecting the different input signals, as well as the different operations of the output signals. Moreover, in some instances hysteresis is not desired, particularly when a true differential receiver is required. Thus, multiple comparators would have to be designed and constructed on each chip device.

Therefore, there is a need in the art for a hysteresis mechanism that provides noise tolerance and does not require each individual receiver or comparator to be specifically modified. Moreover, there is a need in the art for a mechanism to disable hysteresis when it is not needed.

SUMMARY OF THE INVENTION

These and other objects, features and technical advantages are achieved by a system and method which uses a reference voltage mechanism to provide hysteresis that is separate from the comparator. The mechanism generates two different voltage values, one high level and one low level. The mechanism will select the proper level based on the output of the comparator. Thus, the reference voltage will be slightly higher or slightly lower than a nominal reference value, and thereby increasing the noise tolerance for signal receiver chips. Note that the comparator is unaffected by the mechanism other than the reference voltage that the comparator uses is being changed.

Since the mechanism is separate from the comparator, different comparators do not have be designed and tested.

Thus, the layout of the comparator can be duplicated throughout the chip design, and modifications to the comparator can be implemented easier and faster. This greatly simplifies the chip production process. Also, the mechanism can be disabled by a shorting some of the nodes of the mechanism together. This change can be made in the metal deposition step of the device fabrication. Thus, if the hysteresis is not needed for a particular comparator, then the mechanism can be effectively removed without having to make changes in the underlying silicon layers.

The inventive mechanism comprises three circuits, with one circuit for providing a high level reference voltage, another circuit for providing a low level reference voltage, and a third circuit for selecting one of the other two circuits to serve as the reference voltage for the comparator based upon the output of the comparator. The high level voltage and the low level voltage are slightly above and below the nominal reference voltage. The differences between each level and the nominal level is the added hysteresis noise margin. The actual voltage levels of the two circuits are determined by the characteristics of preselected FET devices that comprise the circuits.

The inventive mechanism uses the higher voltage level when the output of the comparator is low or ground. Thus, a noise spike in the input signal would have to exceed the nominal level plus the margin of the higher voltage level before causing the comparator to react to the signal. Similarly, the mechanism uses the lower voltage level when the output of the comparator is high or on chip power supply. Thus, a noise spike in the input signal would have to be below the nominal level plus the margin of the lower voltage level before causing the comparator to react to the signal.

Therefore, it is a technical advantage of the present invention to provide a hysteresis noise margin to the operation of a comparator.

It is another technical advantage of the present invention that the hysteresis noise margin is provided by a mechanism separate from the comparator.

It is a further technical advantage of the present invention that the separation of the hysteresis mechanism from the comparator allows the duplication of the comparator without design changes to the comparator.

It is a still further technical advantage of the present invention that the hysteresis mechanism can be disabled by shorting nodes of the mechanism together.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
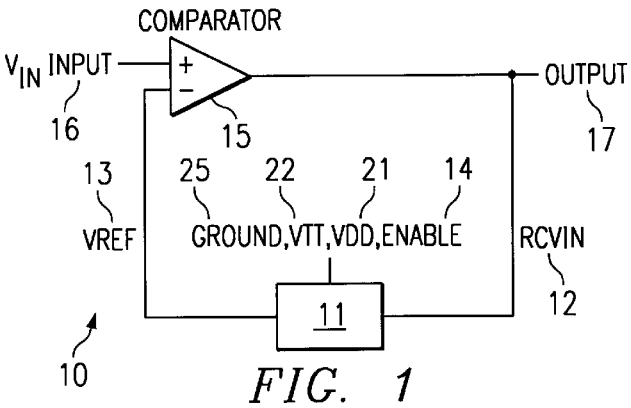
FIG. 1 depicts an arrangement of the inventive voltage mechanism and a comparator.
Figure 5:
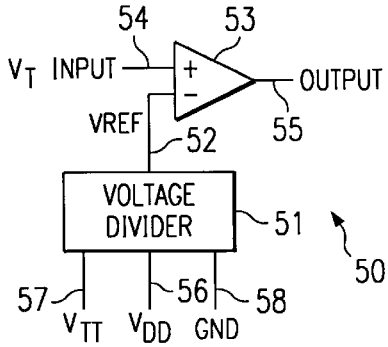
FIG. 5 (PRIOR ART)
FIG. 5 depicts a prior art arrangement of a comparator and voltage divider.

FIG. 1 depicts the inventive mechanism 11 coupled to a comparator 15 in a feedback arrangement 10. Note that the comparator 15 can be any type of comparator, so long as the output of the comparator changes when the relative values of the positive input and the negative input switch. For example, if the positive input is at a higher voltage level than the negative input, then the output of the comparator could be high. Thus, if the negative input is higher than the positive input, then the output could be ground. The inventive mechanism 11 is connected to the output 17 of the comparator 15, and controls the reference voltage $V_{ref}$ 13 based upon the output 17. In order to operate, the inventive mechanism 11 receives a ground voltage 25, a $V_{DD}$ voltage 21 which is an on chip power supply, and a $V_{TT}$ voltage 22 which is an IO supply voltage which provides power for the $V_{IN}$ input signal 16. The mechanism 11 also receives an enable test signal 14 which allows testing of the chip in which the mechanism is incorporated.

Figure 2:
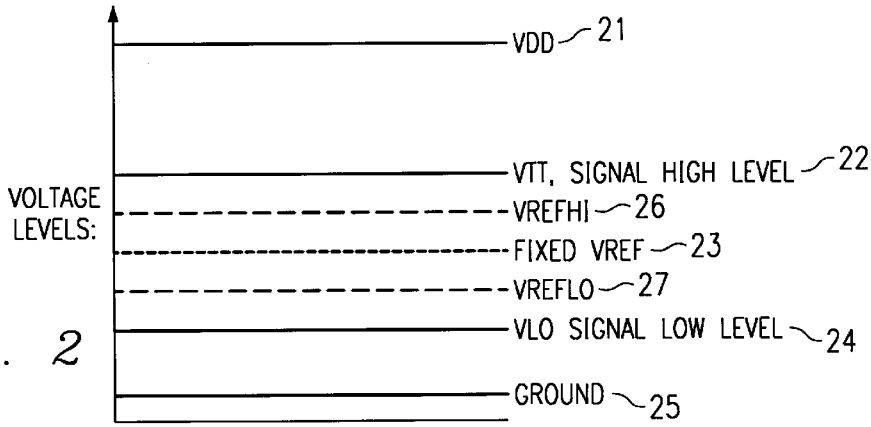
FIG. 2 depicts the voltage levels of the arrangement of FIG. 1.

FIG. 2 depicts the relative voltage levels of the ground voltage 25, the $V_{DD}$ voltage 21, the $V_{TT}$ voltage 22, and the $V_{LO}$ voltage 24. Note that $V_{TT}$ represents the highest voltage of the $V_{IN}$ input signal, and $V_{LO}$ 24 represents the lowest voltage of the $V_{IN}$ input signal. The $V_{ref}$ 13 signal of FIG. 1 can be set to either $V_{refhi}$ 26 or $V_{reflo}$ 27 by the inventive mechanism 11 depending upon the output 17. The fixed $V_{ref}$ 23 voltage level, which is an average of the $V_{refhi}$ 26 and $V_{reflo}$ 27 levels, can be set by making a small change to the inventive mechanism 11. This is discussed later in this description. The $V_{refhi}$ 26 and $V_{reflo}$ 27 levels provide a noise margin in the operation of the comparator. If the output of the comparator is low, then the inventive mechanism switches the reference voltage $V_{ref}$ 13 to $V_{refhi}$ 26. If the output of the comparator is high, then the inventive mechanism switches the reference voltage $V_{ref}$ 13 to $V_{reflo}$ 27. Thus, if noise appears in the input signal 16, which does not cross either $V_{refhi}$ 26 or $V_{reflo}$ 27 (depending on the current setting of the mechanism 11), then the device (not shown) receiving the output of the comparator will not receive an incorrect output signal. The additional noise margin is the difference between the fixed $V_{ref}$ 23 and the $V_{refhi}$ 26 or $V_{reflo}$ 27 (depending on the current setting of the mechanism 11). Note that the inventive mechanism will switch between $V_{refhi}$ 26 and $V_{reflo}$ 27 when the comparator output 17 crosses the threshold voltage for circuit 34, and FETs 35 and 36. Note that the FETs that comprise the circuit 34, as well as FETs 35 and 36, are selected to provide the desired switch voltage.

Figure 3:
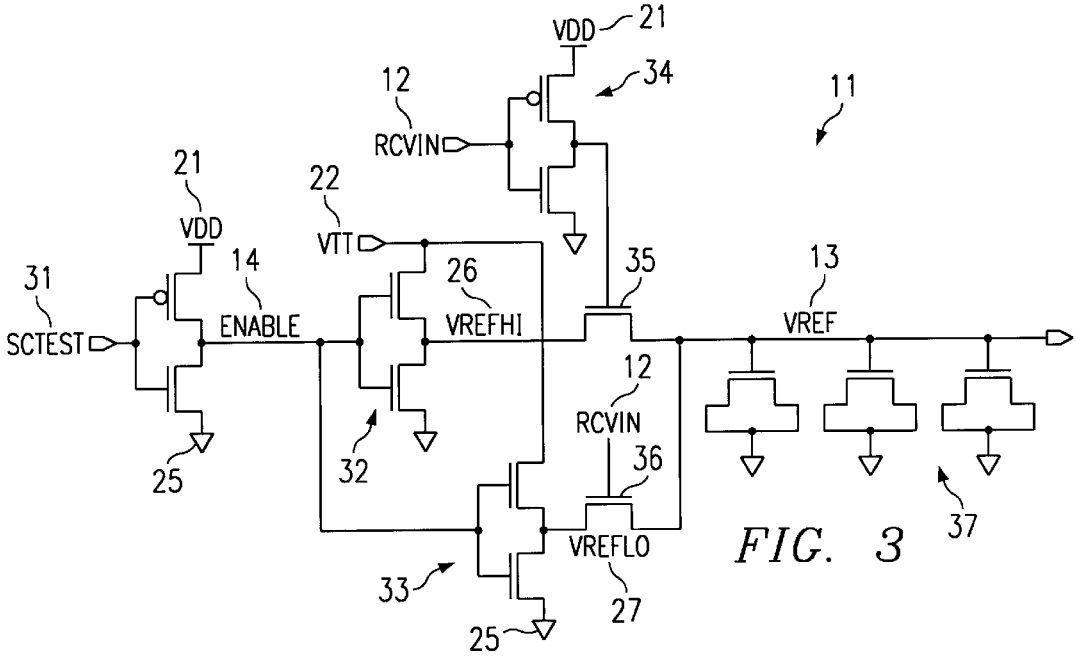
FIG. 3 depicts the internal elements of the inventive voltage mechanism.
Figure 4A:
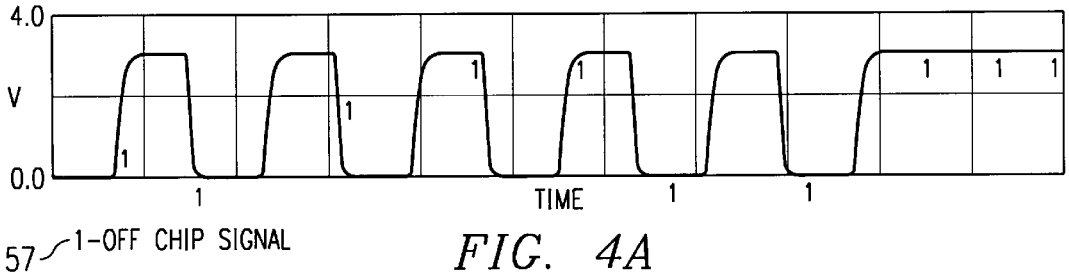
FIGS. 4A–4D depict the effects of the inventive mechanism of FIG. 3 as used in the arrangement of FIG. 1.
Figure 4B:
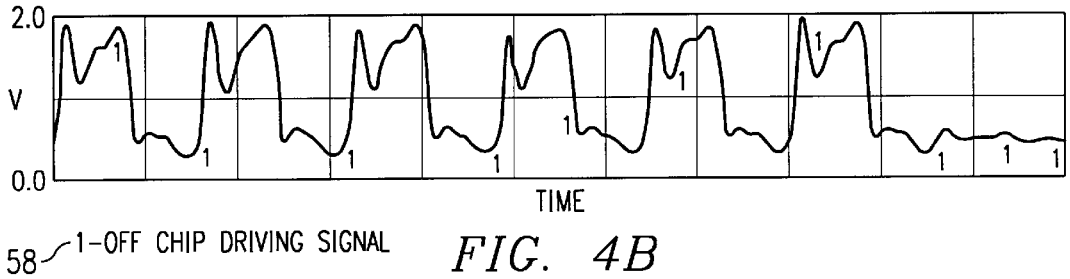
Figure 4C:
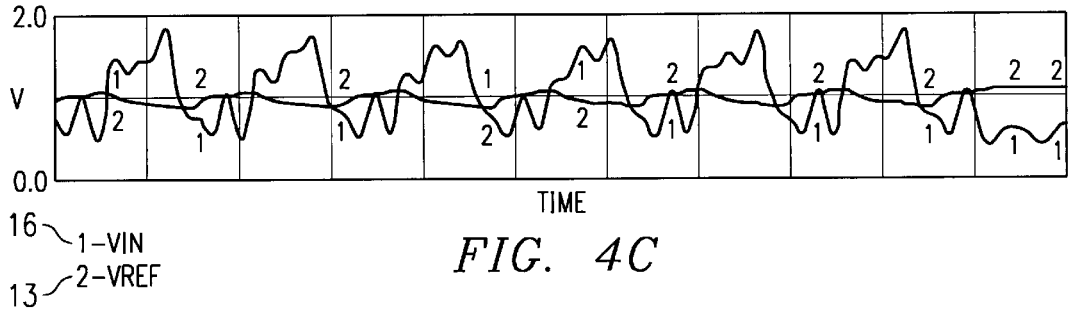
Figure 4D:
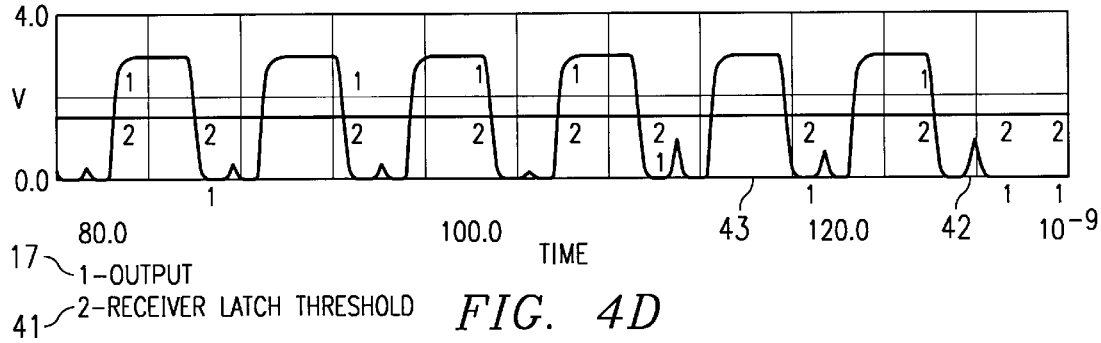

FIG. 3 depicts the internal elements of the inventive mechanism 11. Note that the FETs depicted in FIG. 3 with the circle by the gate are p type FETs, which turn on if the voltage at the gate is ground, and the FETs without the circle are n type, which turn on if the voltage at the gate is high. The mechanism receives three inputs, in addition to the ground voltage 25 and the $V_{DD}$ voltage 21. One input is $V_{TT}$ 22, which represents the highest voltage of the $V_{IN}$ input signal and is the IO supply voltage. Another input is the RCVIN signal 12, which is the feedback signal from the output 17 of the comparator 15. The third input is the static current (SC) test signal 31, which is used to determine whether there are shorts between power supplies in the chip device. Activating SC test (i.e., high) connects enable 14 to ground, and turns off circuits 32 and 33. This allows a check to be made to determine whether any current is being drawn from $V_{DD}$ to ground. Deactivating SC test (i.e., low) connects enable 14 to $V_{DD}$ 21, and turns on circuits 32 and 33.

Circuits 32 and 33 generate $V_{refhi}$ 26 and $V_{reflo}$ 27, respectively. The nFETS that comprise the circuits are selected to provide the proper reference voltages. By changing the characteristics of the nFETs, such as width or length, the voltage levels of $V_{refhi}$ 26 and $V_{reflo}$ 27 can be changed. Note that such changes would occur during device design and fabrication. Circuit 34, FET 35 and FET 36 switch the reference voltage $V_{ref}$ 13 between $V_{refhi}$ 26 and $V_{reflo}$ 27, depending upon the RCVIN signal 12. If RCVIN is high, then the gate of FET 35 is low, FET 35 is off, and circuit 32 is disconnected from $V_{ref}$ 13. Furthermore, the gate of FET 36 is high, FET 36 is on, and circuit 33 is connected to $V_{ref}$ 13. Thus, $V_{ref}$ 13 is connected to $V_{reflo}$ 27. Therefore, when the output of the comparator is high, the reference voltage is $V_{reflo}$ 27. Similarly, if RCVIN is low, then the gate of FET 36 is low, FET 36 is off, and circuit 33 is disconnected from $V_{ref}$ 13. Furthermore, the gate of FET 35 is high, FET 35 is on, and circuit 32 is connected to $V_{ref}$ 13. Thus, $V_{ref}$ 13 is connected to $V_{refhi}$ 26. Therefore, when the output of the comparator is low, the reference voltage is $V_{refhi}$ 26.

Note that the nodes of $V_{ref}$ 13, $V_{refhi}$ 26, and $V_{reflo}$ 27 can be shorted together. This will average $V_{refhi}$ 26 and $V_{reflo}$ 27 together, and yield fixed $V_{ref}$ 23, which is tied to $V_{ref}$ 13. The shorting can be accomplished in the metal layer deposition steps during device fabrication, which are some of the last processing steps of fabrication. Note that this does not effect the other underlying processing steps. Since the transistor level of a chip is developed first, followed by the metal layers, it is easier to make changes to the metal layers, instead of the underlying transistor layers. Thus, a second version of the chip can be made merely by making changes in the metal layer. Note that changes to the underlying layers requires a complete revalidation and refabrication of the chip.

Note that a trade off of using hysteresis to increase the noise margin is that some delay will be added to the circuit. This is because the signal has to have a longer transition-time to cross the higher reference voltage. However, if during testing, the noise factor is found not to be a problem, and the signals are clear, then the extra noise margin would not be needed. Thus, by shorting $V_{refhi}$, $V_{reflo}$, and $V_{ref}$ together, the hysteresis is disabled and the extra delay is eliminated. By making this change in metal, a complete redesign of the chip is not required.

Circuitry 37 provides on chip bypassing. The connection of the sources and drains of the FETs to ground forms channel capacitance between ground and the reference voltage. The capacitance is used to stabilize the reference voltage.

Figure 6A:
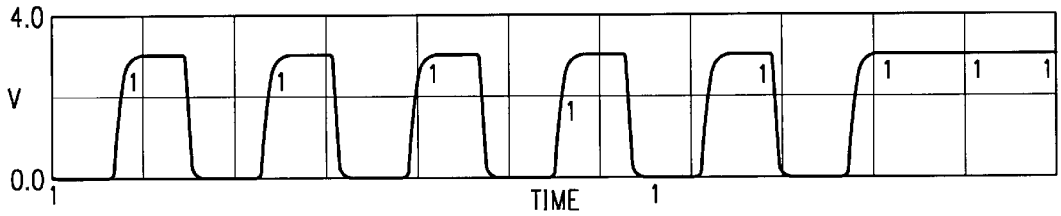
FIG. 6A (PRIOR ART)
FIGS. 6A–6D depict the effects of the prior art arrangement of FIG. 5.
Figure 6B:
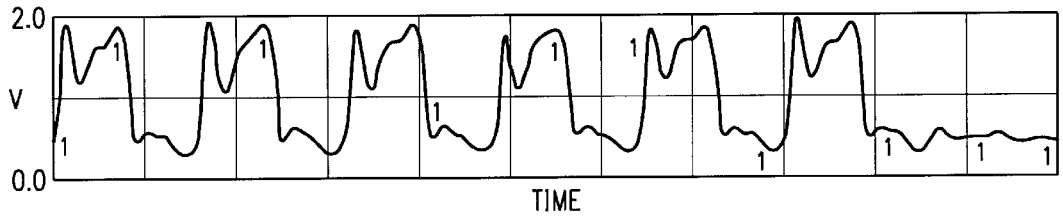
FIG. 6B (PRIOR ART)
Figure 6C:
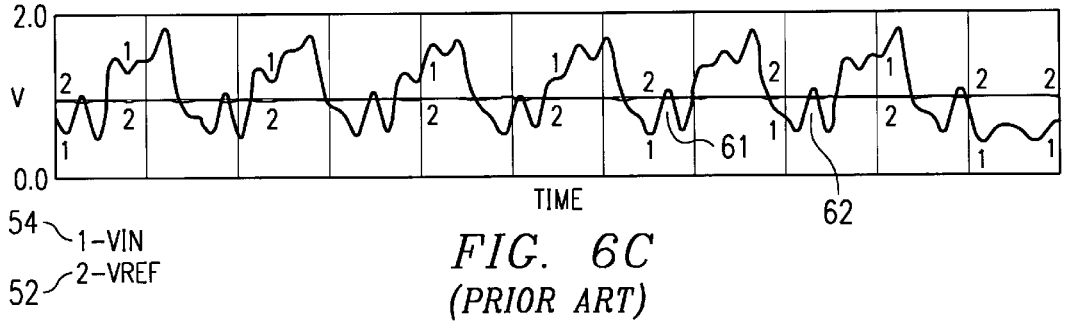
FIG. 6C (PRIOR ART)
Figure 6D:
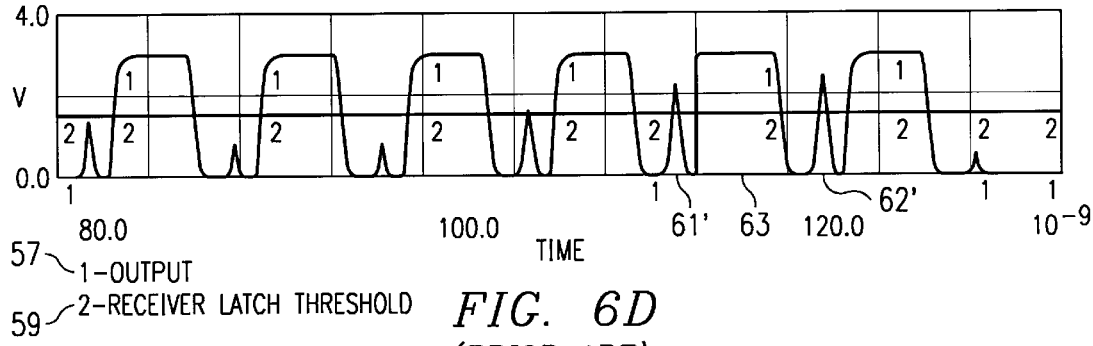
FIG. 6D (PRIOR ART)

FIGS. 4A–4D depicts the effects of the inventive mechanism 11 as used with the comparator 15. Each of the graphs of FIGS. 4A–4D depict various voltages of the arrangement of FIG. 1 at a common reference time. Note that the time line is in nanoseconds. The off chip signal 57 is the signal generated by an off chip (i.e. off of the comparator chip) device. The off chip driving signal is the signal sent by the driving circuit of the off chip device. Note the noise introduced by the transmission line effects. Further note that additional noise may be introduced by a layout with multi-drop buses having unterminated stubs. This signal that is received by the receiving circuitry, $V_{IN}$ 16, is replete with noise when compared with off chip signal 57. Note that the reference voltage $V_{ref}$ 13 rises and falls with respect to the output signal 17. This shows the switching between $V_{refhi}$ 26 and $V_{reflo}$ 27. Further note that spikes 42 do not exceed the receiver latch threshold voltage 41. Thus, the noise has not caused any erroneous signals to be propagated through the receiving chip. The small delay introduced by the inventive mechanism can be seen be comparing pulse 43 of FIG. 4D with pulse 63 of FIG. 6D.

Although the present invention and its advantages have been described in detail, it should be understood that various changes, substitutions and alterations can be made herein without departing from the spirit and scope of the invention as defined by the appended claims.

What is claimed is:

1. A mechanism for generating an output reference voltage for use by a component, wherein the mechanism is selectable between a hysteresis output reference voltage and a singular output reference voltage, the mechanism comprising:

a first circuit for generating a first reference voltage;

a second circuit for generating a second reference voltage, wherein the first reference voltage is higher than the second reference voltage;

a third circuit which selects one of the first reference voltage and the second reference voltage as the hysteresis output reference voltage based upon an output of the component; and wherein the first and second circuits are selectably coupled together to produce the singular output reference voltage during fabrication.

2. The mechanism of claim 1, wherein:

the mechanism provides a noise margin for an operation of the component.

3. The mechanism of claim 1, wherein:

the third circuit selects the second reference voltage as the output reference voltage when the output of the component exceeds a switch voltage; and the third circuit selects the first reference voltage as the output reference voltage when the output of the component falls below the switch voltage.

4. The mechanism of claim 1, wherein:

the component is a comparator.

5. The mechanism of claim 1, wherein the first circuit comprises:

a first FET having its drain coupled to a signal power supply voltage; and a second FET having its drain coupled to the source of the first FET at a connection point, and its source coupled to a ground voltage;

wherein the first reference voltage is formed at the connection point.

6. The mechanism of claim 5, wherein:

design characteristics of the first FET and the second FET are selected to form the first reference voltage.

7. The mechanism of claim 5, wherein:

a gate of the first FET and a gate of the second FET are coupled to a test circuit;

wherein the test circuit turns off the first FET and the second FET when a chip upon which the mechanism is resident is to be tested, and otherwise turns on the first FET and the second FET.

8. The mechanism of claim 5, wherein:

the first FET and the second FET are n type FETs.

9. The mechanism of claim 1, wherein the second circuit comprises:

a first FET having its drain coupled to a signal power supply voltage; and a second FET having its drain coupled to the source of the first FET at a connection point, and its source coupled to a ground voltage;

wherein the second reference voltage is formed at the connection point.

10. The mechanism of claim 9, wherein:

design characteristics of the first FET and the second FET are selected to form the second reference voltage.

11. The mechanism of claim 9, wherein:

a gate of the first FET and a gate of the second FET are coupled to a test circuit;

wherein the test circuit turns off the first FET and the second FET when a chip upon which the mechanism is resident is to be tested, and otherwise turns on the first FET and the second FET.

12. The mechanism of claim 9, wherein:

the first FET and the second FET are n type FETs.

13. The mechanism of claim 1, wherein the third circuit comprises:

a first FET coupled between the first circuit and a mechanism output; and a second FET coupled between the second circuit and the mechanism output;

wherein the first FET is off and the second FET is on when the output of the component is high, thereby connecting the second circuit to the mechanism output and providing the second reference voltage as the output voltage; and the first FET is on and the second FET is off when the output of the component is low, thereby connecting the first circuit to the mechanism output and providing the first reference voltage as the output voltage.

14. The mechanism of claim 13, wherein:

the component is high when the output voltage of the component exceeds a switch voltage; and the component is low when the output of the component falls below the switch voltage.

15. The mechanism of claim 13, wherein:

the first FET and the second FET are n type FETs;

the gate of the second FET is coupled to the output of the comparator; and the gate of the first FET is coupled to a gate circuit, wherein the gate circuit provides a ground voltage when the output of the comparator is high and a high voltage when the output of the comparator is low.

16. The mechanism of claim 1, further comprising:

means for stabilizing the output reference voltage.

17. The mechanism of claim 1, wherein:

the nodes are coupled with a selectable shorted connection between the first circuit and the second circuit thereby forming the singular output reference voltage which is an average of the first reference voltage and the second reference voltage.

18. The mechanism of claim 17, wherein the shorted connection is formed during formation of a metal layer in fabricating a chip upon which the mechanism is resident.

19. A mechanism for generating an output reference voltage for use by a comparator, wherein the mechanism is selectable between a hysteresis output reference voltage and a singular output reference voltage, and the mechanism provides a noise margin for an operation of the comparator, the mechanism comprising:

a first circuit for generating a first reference voltage;

a second circuit for generating a second reference voltage, wherein the first reference voltage is higher that the second reference voltage;

a third circuit which selects one of the first reference voltage and the second reference voltage as the hysteresis output reference voltage based upon an output of the comparator;

wherein the first and second circuits are selectably coupled together to produce the singular output reference voltage during fabrication; and wherein the third circuit selects the second reference voltage as the output reference voltage when the output of the comparator exceeds a switch voltage, and the third circuit selects the first reference voltage as the output reference voltage when the output of the comparator falls below the switch voltage.

20. The mechanism of claim 19, wherein the first circuit comprises:

a first n type FET having its drain coupled to a signal power supply voltage; and a second n type FET having its drain coupled to the source of the first FET at a connection point, and its source coupled to a ground voltage;

wherein the first reference voltage is formed at the connection point, and design characteristics of the first FET and the second FET are selected to form the first reference voltage.

21. The mechanism of claim 19, wherein the second circuit comprises:

a first n type FET having its drain coupled to a signal power supply voltage; and a second n type FET having its drain coupled to the source of the first FET at a connection point, and its source coupled to a ground voltage;

wherein the second reference voltage is formed at the connection point, and design characteristics of the first FET and the second FET are selected to form the second reference voltage.

22. The mechanism of claim 19, wherein the third circuit comprises:

a first n type FET coupled between the first circuit and a mechanism output; and a second n type FET coupled between the second circuit and the mechanism output;

wherein when the output of the comparator is high, then the first FET is off and the second FET is on, thereby connecting the second circuit to the mechanism output and providing the second reference voltage as the output voltage; and when the output of the comparator is low, then the first FET is on and the second FET is off, thereby connecting the first circuit to the mechanism output and providing the first reference voltage as the output voltage.

23. The mechanism of claim 22, wherein:

the comparator is high when the output voltage of the comparator exceeds a switch voltage; and the comparator is low when the output of the comparator falls below the switch voltage.

24. The mechanism of claim 22, wherein:

the gate of the second FET is coupled to the output of the comparator; and the gate of the first FET is coupled to a gate circuit, wherein the gate circuit provides a ground voltage when the output of the comparator is high and a high voltage when the output of the comparator is low.

25. The mechanism of claim 19, wherein:

the nodes are coupled with a selectable shorted connection between the first circuit and the second circuit thereby forming the singular output reference voltage which is an average of the first reference voltage and the second reference voltage.

26. The mechanism of claim 25, wherein the shorted connection is formed during formation of a metal layer in fabricating a chip upon which the mechanism is resident.

27. A method for generating an output reference voltage for use by a comparator that provides a noise margin for an operation of the comparator, wherein the output reference voltage is selectable between a hysteresis output reference voltage and a singular output reference voltage, the method comprising the steps of:

generating a first reference voltage;

generating a second reference voltage, wherein the first reference voltage is higher that the second reference voltage;

selecting one of the first reference voltage and the second reference voltage as the hysteresis output reference voltage based upon an output of the component; and setting the first reference voltage and the second reference voltage equal to a third reference voltage which is the singular output reference voltage, wherein the step of setting is selectably enabled during fabrication.

28. The method of claim 27, wherein the step of selecting comprises the steps of:

selecting the second reference voltage as the output reference voltage when the output of the comparator exceeds a switch voltage; and selecting the first reference voltage as the output reference voltage when the output of the comparator falls below the switch voltage.

29. The method of claim 27, further comprising the step of:

stabilizing the output reference voltage.

30. The method of claim 27, wherein a first circuit generates the first reference voltage and a second circuit generates the second reference voltage, the step of setting comprises the step of:

shorting the first circuit and the second circuit together to form the third reference voltage which is an average of the first reference voltage and the second reference voltage.

31. The method of claim 30, wherein:

the step of shorting is performed during formation of a metal layer in fabricating a chip upon which the mechanism is resident.

* * * * *

UNITED STATES PATENT AND TRADEMARK OFFICE

CERTIFICATE OF CORRECTION

PATENT NO. : 6,300,822 B1
DATED : October 9, 2001
INVENTOR(S) : Brian Cardanha et al.

It is certified that error appears in the above-identified patent and that said Letters Patent is hereby corrected as shown below:

Column 9,
Line 32, delete “that” and insert therefor -- than --

Signed and Sealed this

Twenty-ninth Day of June, 2004

JON W. DUDAS
*Acting Director of the United States Patent and Trademark Office*